US011464378B2

(12) United States Patent
Muir et al.

(10) Patent No.: US 11,464,378 B2
(45) Date of Patent: Oct. 11, 2022

(54) CLEANING DEVICE

(71) Applicant: BLACK & DECKER INC., New Britain, CT (US)

(72) Inventors: Derek Muir, Durham (GB); Andrew Walker, Durham (GB); Cavan Gray, County Durham (GB); Jack Richardson, Yorkshire (GB)

(73) Assignee: Black & Decker, Inc., New Britain, CT (US)

( * ) Notice: Subject to any disclaimer, the term of this patent is extended or adjusted under 35 U.S.C. 154(b) by 409 days.

(21) Appl. No.: 16/660,000

(22) Filed: Oct. 22, 2019

(65) Prior Publication Data

US 2020/0046187 A1 Feb. 13, 2020

Related U.S. Application Data

(63) Continuation of application No. 15/805,747, filed on Nov. 7, 2017, now Pat. No. 10,485,393.

(30) Foreign Application Priority Data

Nov. 17, 2016 (EP) ..... 16199418

(51) Int. Cl.
*A47L 9/10* (2006.01)
*A47L 5/28* (2006.01)
(Continued)

(52) U.S. Cl.
CPC ..... *A47L 9/108* (2013.01); *A47L 5/225* (2013.01); *A47L 5/28* (2013.01); *A47L 9/149* (2013.01);
(Continued)

(58) Field of Classification Search
CPC . A47L 9/108; A47L 5/225; A47L 5/28; A47L 9/149; A47L 9/1683; A47L 9/242; A47L 9/2857; A47L 9/32; A47L 9/325
See application file for complete search history.

(56) References Cited

U.S. PATENT DOCUMENTS

2003/0084536 A1 5/2003 Yung
2006/0123749 A1 6/2006 Park
2008/0263815 A1 10/2008 Oh et al.

FOREIGN PATENT DOCUMENTS

EP 1464264 A2 10/2004
EP 1671569 B1 9/2009
(Continued)

OTHER PUBLICATIONS

Extended EP Search Report dated May 19, 2017 relating to EP application No. 16199418.1.

*Primary Examiner* — David Redding
(74) *Attorney, Agent, or Firm* — John Yun

(57) ABSTRACT

A vacuum cleaner comprises: a housing and a motor fan assembly mounted in the housing, the motor fan assembly arranged to generate an air flow. A removable dirt container is mountable on the housing and in fluid communication with a dirty air inlet and the motor fan assembly. A moveable dirt compactor is mounted in the dirt container and moveable between a stowed position and a dirt compacting position wherein the moveable dirt compactor is closer to one end of the dirt container in the dirt compacting position than in the stowed position. Wherein the dirt container comprises a primary handle for actuating the moveable dirt compactor with a first hand and a first auxiliary handle for allowing the user to grip with a second hand.

10 Claims, 6 Drawing Sheets

(51) Int. Cl.

| | |
|---|---|
| ***A47L 9/32*** | (2006.01) |
| ***A47L 9/16*** | (2006.01) |
| ***A47L 9/14*** | (2006.01) |
| ***A47L 5/22*** | (2006.01) |
| ***A47L 9/24*** | (2006.01) |
| ***A47L 9/28*** | (2006.01) |

(52) U.S. Cl.
CPC ..... *A47L 9/1683* (2013.01); *A47L 9/242* (2013.01); *A47L 9/2857* (2013.01); *A47L 9/32* (2013.01); *A47L 9/325* (2013.01)

(56) References Cited

FOREIGN PATENT DOCUMENTS

| | | | |
|---|---|---|---|
| JP | S53145360 | A | 12/1978 |
| WO | 2012009782 | A1 | 1/2012 |
| WO | 2012113414 | A1 | 8/2012 |

CLEANING DEVICE

CROSS-REFERENCE TO RELATED APPLICATION

The present application is a continuation of U.S. patent application Ser. No. 15/805,747, filed Nov. 7, 2017, entitled "Cleaning Device", which claims priority to European Patent Application No. 16199418.1 filed Nov. 17, 2016. The entire contents of that application are expressly incorporated herein by reference.

FIELD OF THE INVENTION

The present invention relates to a vacuum cleaner. In particular the present invention relates to improved dust container capacity.

BACKGROUND OF THE INVENTION

Vacuum cleaners typically have an on board dirt container for receiving and storing dirt and debris that has been sucked up from a surface that is being cleaned. Periodically the dirt container must be emptied and this can be an undesirable task for the user. It is known to increase the volume of the dirt container by providing a compaction mechanism in the dirt container. Examples of compaction mechanisms are shown in EP 1 671 569 and US 2008/0263815. This squashes the contents of the dirt container and increases the effective volume of the dirt container and means that the dirt container can be emptied less frequently.

A problem with the compaction mechanisms is that a user may have difficultly emptying and operating the compaction mechanism particularly if the user is operating the vacuum cleaner in a confined space. Furthermore the vacuum cleaner may move or topple over if the user attempts to operate the compaction mechanism in an awkward position.

Embodiments of the present invention aim to address the aforementioned problems.

SUMMARY OF THE INVENTION

According to an aspect of the present invention there is a vacuum cleaner comprising: a housing; a motor fan assembly mounted in the housing, the motor fan assembly arranged to generate an air flow; a removable dirt container mountable on the housing and in fluid communication with a dirty air inlet and the motor fan assembly; a moveable dirt compactor mounted in the dirt container and moveable between a stowed position and a dirt compacting position wherein the moveable dirt compactor is closer to one end of the dirt container in the dirt compacting position than in the stowed position; wherein the dirt container comprises a primary handle for actuating the moveable dirt compactor with a first hand and a first auxiliary handle for allowing the user to grip with a second hand.

By providing two handles for the user to grip, the user can easily exert force on the dirt compactor in a controlled manner. This means that the vacuum cleaner is less likely to topple or move when the user operates the dirt compactor.

Preferably the primary handle is moveably mounted on a front surface of the dirt container. By providing the primary handle on the front, the dirt compactor is easily operable irrespective of whether the dirt container is mounted on the vacuum cleaner unit or not.

Preferably the primary handle is mechanically coupled to the moveable dirt compactor. This means that movement of the primary handle directly moves the dirt compactor.

Preferably the primary handle comprises a spring for biasing the moveable dirt compactor to the stowed position. This means that the dirt compactor returns to the stowed position after the user operates the primary handle and the dirt compactor.

Preferably the first auxiliary handle is a first auxiliary handle mounted on the top removable dirt container. This means that the user is able to grip the dirt container and operate the dirt compactor in a controlled manner when the dirt container is not attached to the vacuum cleaner.

Preferably the at least one auxiliary handle is a second auxiliary handle mounted on the housing. This means that the user is able to grip the vacuum cleaner and operate the dirt compactor in a controlled manner when the dirt container is attached to the vacuum cleaner. Furthermore by having two auxiliary handles, the user is able to operate the dirt compactor when the dirt container is mounted on the vacuum cleaner and when the dirt container is separate from the vacuum cleaner.

Preferably the second auxiliary handle is concealed when the removable dirt container is mounted on the housing. This means that at least one of the auxiliary handles does not stick out when the dirt container is mounted on the vacuum cleaner. This makes the vacuum cleaner more compact and portable.

Preferably the housing comprises a latch mechanism for releasing the dirt container from the housing. In this way the dirt container is selectively releasable and the latch mechanism prevents the dirt container from accidentally being removed from the vacuum cleaner.

Preferably the latch mechanism comprises a spring biased hook configured to engage the first auxiliary handle when the removable dirt container is mounted on the housing. This provides a dual use to the first auxiliary handle and means that the vacuum cleaner can be more compact and portable.

Preferably the vacuum cleaner comprises a dirt separator mounted in the dirt container located in an air flow path between the dirty air inlet and the motor fan assembly. By mounting the dirt separator in the dirt container, the vacuum cleaner is more compact and portable.

Preferably the moveable dirt compactor sweeps a surface of the dirt separator when the moveable dirt compactor moves from the stowed position to the dirt compacting position. Preferably the moveable dirt compactor engages an inner surface of the dirt container. This means that the dirt separator is cleaned after every compaction operation and the air flow through the dirt separator is more efficient.

Preferably one end of the dirt container comprises a door for emptying the dirt container. Preferably the dirt container comprises a first latch for releasing the door. Preferably the door comprises a detent for maintaining the door in an open position. This means that emptying the dirt container is easier when the user grips the vacuum cleaner over a bin or trash can.

BRIEF DESCRIPTION OF THE DRAWINGS

Various other aspects and further embodiments are also described in the following detailed description and in the attached claims with reference to the accompanying drawings, in which:

DETAILED DESCRIPTION OF INVENTION

Figure 1:
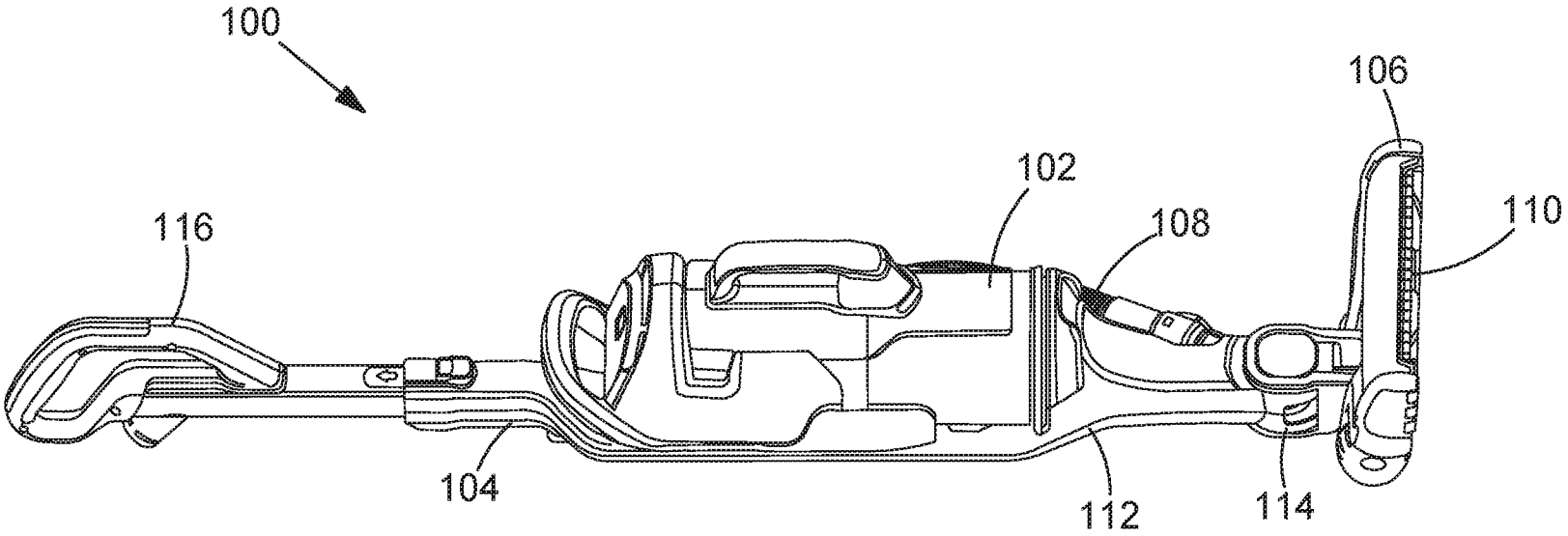
FIG. 1 shows a perspective view of the vacuum cleaner.

FIG. 1 shows a perspective view of a vacuum cleaner 100. The vacuum cleaner 100 comprises a vacuum cleaner unit 102 which is mounted in a chassis 104. The chassis 104 is optional. In this way the vacuum cleaner 100 is a stickvac type vacuum cleaner. In other embodiments the vacuum cleaner 100 can be any type of vacuum cleaner such as an upright vacuum cleaner, a canister vacuum cleaner or a handheld vacuum cleaner.

The chassis 104 comprises a floorhead 106 for engaging surfaces to be cleaned. The floorhead 106 has a floorhead dirty air inlet 110 which is in fluid communication with a hose 108 of the vacuum cleaner unit 102. The floorhead 106 is coupled to the chassis body 112 via an articulated joint 114. The articulated joint 114 permits the floorhead 106 to move with respect to the chassis body 112 in two degrees of freedom. The articulated joint 114 comprises two pivoting joints which have pivoting axes perpendicular to each other. The chassis also comprises a handle 116 for the user to grip and steer the vacuum cleaner 100 during use.

The vacuum cleaner unit 102 is releasably removable from the chassis 104. The vacuum cleaner unit 102 comprises projecting ribs (not shown) which slot into a reciprocal recess (not shown) on the chassis 104. The vacuum cleaner unit is mountable on the chassis 104 and locked to the chassis 104 with a latch mechanism (not shown). The latch mechanism is operated when the vacuum cleaner unit 102 is to be released from the chassis 104.

Figure 2:
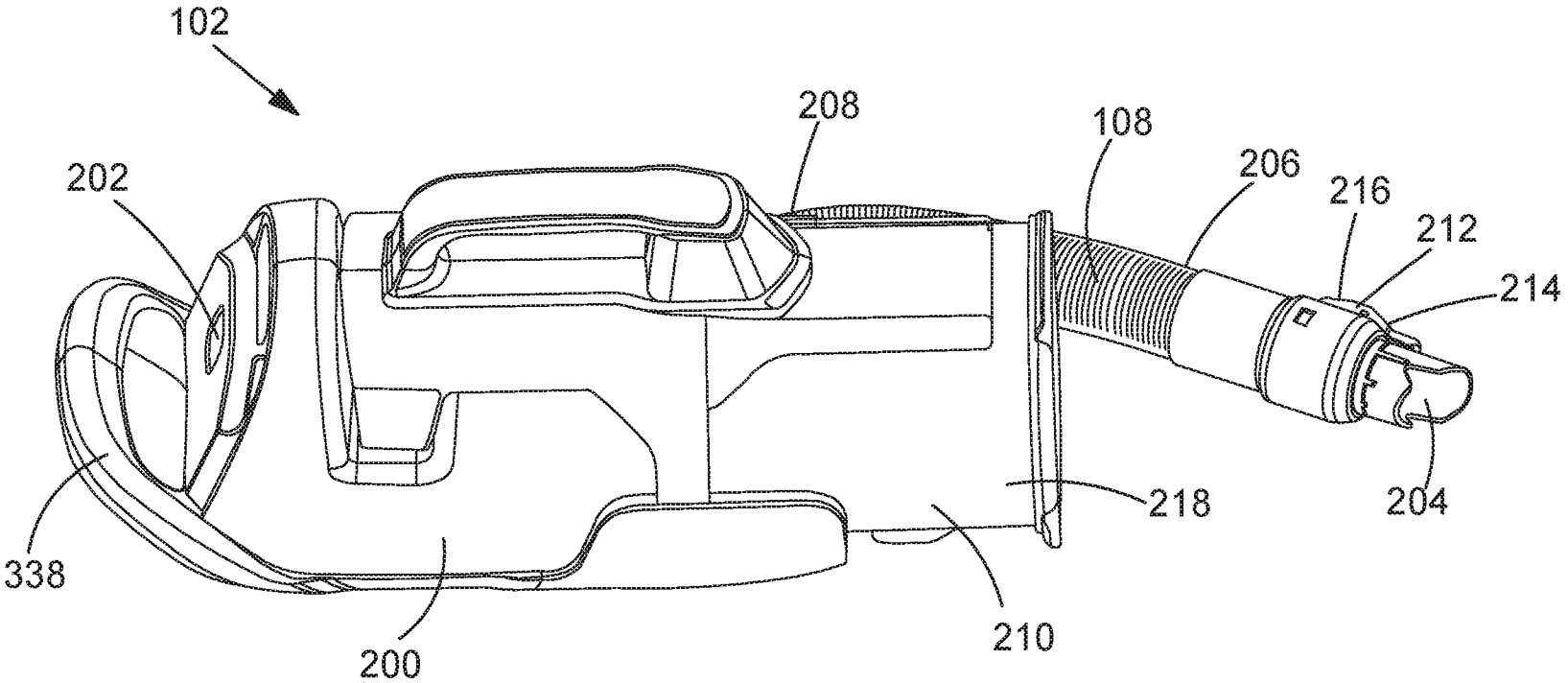
FIG. 2 shows perspective view of the vacuum cleaner.

The vacuum cleaner unit 102 will now be discussed in further detail in reference to FIG. 2. FIG. 2 shows a perspective view of the vacuum cleaner unit 102. The vacuum cleaner unit 102 is operable remote from the chassis 104. Optionally the vacuum cleaner unit 102 is a stand-alone unit which does not couple to a chassis 104 as shown in FIG. 1.

The vacuum cleaner unit 102 comprises a housing 200. The housing 200 comprises a clam shell type construction comprises two halves which are fastened together. The halves of the housing 200 are fastened together with screws but in alternative embodiments any suitable means for fastening the housing together may be used such as glue, clips, bolts and so on.

Figure 3:
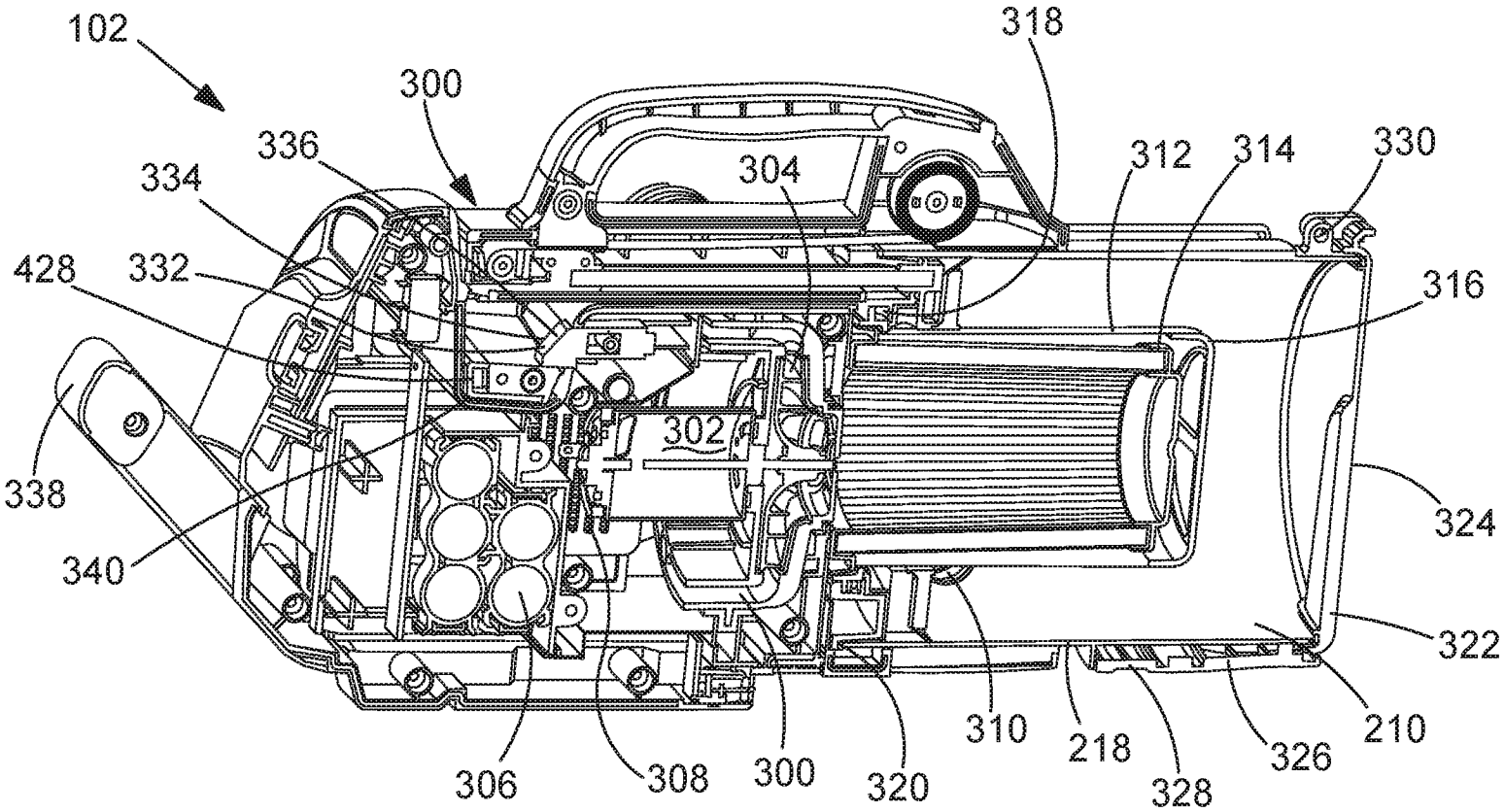
FIG. 3 shows a side cross sectional view of the vacuum cleaner.

The vacuum cleaner unit 102 comprises a motor fan assembly 300 which is best shown in FIG. 3. FIG. 3 shows a perspective cross section view of the vacuum cleaner unit 102. The motor fan assembly 300 comprises a motor 302 and a fan 304 for generating a negative pressure for sucking up dirt and debris via the dirty air inlet 204. The motor fan assembly 300 is housed within the housing 200 and electrically connected to a power source 306. The power source 306 is a battery comprising a plurality of battery cells. In other embodiments the vacuum cleaner unit 102 additionally or alternatively comprises a mains electricity supply (not shown).

The motor fan assembly 300 is actuated with a first switch 202. The first switch 202 is a main ON/OFF switch which controls power to the motor fan assembly 300.

Turning back to FIG. 2, the motor fan assembly 300 is in fluid communication with a dirty air inlet 204. The dirty air inlet 204 is coupled to a first end 206 of the hose 108 which couples to the floorhead 106 as shown in FIG. 1. The first end 204 of the hose 108 comprises a hose coupling mechanism 212. The hose coupling mechanism 212 selectively couples the first end 204 of the hose 108 to the floorhead 106. This means that the hose 108 does not accidentally come loose from the floorhead 106. Additionally the hose coupling mechanism 212 selectively couples the first end 204 to one or more accessories. The accessories that couple to the first end 204 can be one or more from the following; a brush, a crevice tool, a pet hair tool, a scrubber, an extension tube, a powered brush unit or any other suitable cleaning tool. The hose coupling mechanism 212 comprises a sprung biased pivoting latch 214. The latch 214 is biased to a locked position and when the user wishes to release the first end 204 from an accessory, the use depresses a button 216 and the latch moves to an unlocked position and disengages from the accessory permitting its removal. When the user releases the button 216, the latch snaps back into the locked position. The hose coupling mechanism 212 is optional and the first end 204 of the hose 108 may comprise any other suitable means for mounting accessories thereto. For example the accessories may screw fit or push friction fit on to the first end 204.

A second end 208 of the hose 108 is mounted to the housing 200 and in fluid communication with a dirt container 210. The second end 208 is mounted to an aperture 310 in a wall 218 of the dirt container 210. In this way there is an air flow pathway from the dirty air inlet 204 to the dirt container 210 and to the motor fan assembly 300. The motor fan assembly 300 exhausts clean air out via exhausts holes 308.

The second end 208 of the hose mounted on the wall of the dirt container 210 is better shown in FIG. 3. The dirt container 210 comprises a dirt separator 312 which is positioned in the airflow path between the dirty air inlet 204 and the motor fan assembly 300. The dirt separator 312 comprises a prefilter perforated shroud 316 which encloses a filter 314. For the purposes of clarity the individual perforations of the perforated shroud 316 are not shown. In some embodiments the dirt separator 312 comprises only either the perforated shroud 316 or the filter 314. Both the prefilter 316 and the filter 314 separate dirt and debris entrained in the air flow. The filter 314 is an air permeable pleated filter. The aperture 310 is mounted in the wall 218 of the dirt container 210 such that the air is inserted tangentially to the dirt container 210. This means that the air swirls around in the dirt container 210 before the air flow is sucked through the dirt separator 312. The air flow upstream of the dirt separator 312 is clean and air outputted from the motor fan assembly 300 does not contain any dirt or debris entrained in the air flow. In some embodiments the dirt separator 312 is not a pleated filter or a perforated shroud. Instead the dirt separator 312 is a cyclonic separator or a multistage cyclonic separator.

The dirt separator 312 is mounted in a lid 320 at a first end 318 of the dirt container 210. The lid 320 is sealed against the wall 218 of the dirt container 210 and comprises a hole therethrough for mounting the dirt separator 312. The lid 320 is sealed against the wall 218 of the dirt container 210 with a resilient member 402 (shown in FIG. 4*a*). The resilient member 402 is an annular rubber seal that is compressed between the lid 320 and the wall 218.

A second end 322 of the dirt container 210 comprises a hinged door 324. The door 324 is sprung biased and hinged at pivot 330. A door release mechanism 326 releases the door 324 from the dirt container 210. The door release mechanism 326 comprises a sprung biased pivoting latch 326. When a user presses the button 328 of the latch 326, the latch 326 moves into an unlocked position and the door 324 is urged by the spring in the pivot 330 into an open position.

In some embodiments the pivot 330 does not have a spring and the door is not sprung loaded. Instead the door 324 has a stop member 442 to ensure that the door only opens to a predetermined angle, for example 90 degrees of pivoting rotation with respect to the dirt container 210. The door also has a resilient detent 440 to ensure that the door will stay open when the user empties the dirt container 210. In this way the door 324 comprises a detent 440 for maintaining the door in an open position. In order for the user to close the door 324 the user pivots the door 324 until the detent 440 snaps out of position and the door 324 is free to pivot and be closed. Optionally the door 324 is spring biased and also comprises the detent 440 and the stop member 442.

When the door 324 is open, dirt and debris held in the dirt container 210 can be emptied into a bin. In other embodiments the door is not sprung biased. Furthermore the door release mechanism 326 is alternatively a clip (not shown) mounted on the door which engages with a reciprocal recess on the wall 218. Such a clip may be a living hinge. In yet another embodiment the dirt container 210 does not have a door at the second end 322. Instead the dirt container 210 is emptied by removing the lid 320 from the dirt container 210.

The dirt container 210 is removable from the vacuum cleaner unit 102. This means that the dirt container 210 can be removed from the housing 200 and emptied separately from the vacuum cleaner unit 102. This means that the user does not have to carry the entire vacuum cleaner unit 102 when emptying the dirt container 210. This makes emptying easier because the user does not have to lift the weight of the battery 306 and the motor fan assembly 300 when holding the dirt container 210 over the bin.

During use the dirt and debris sucked up at the dirty air inlet 204 is collected in the dirt container 210. In order to increase the effective volume in the dirt container 210, the dirt container 210 comprises a moveable dirt compactor 400. The moveable dirt compactor 400 will now be discussed in further detail with respect to FIGS. 4*a* and 4*b*.

Figure 4B:
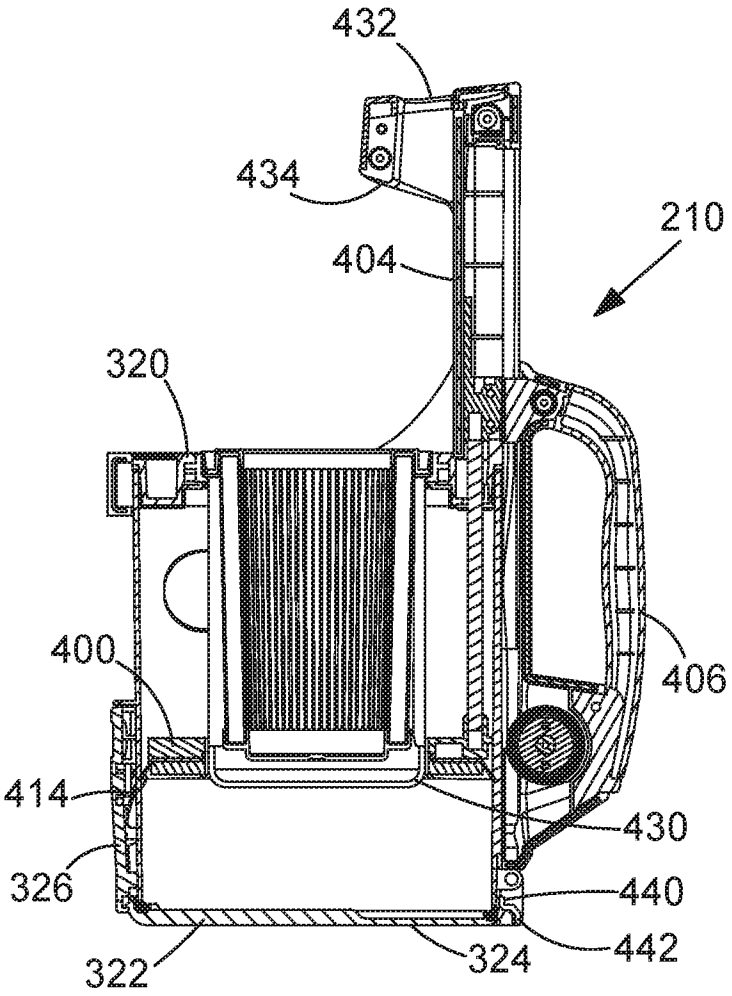
FIGS. 4*a* and 4*b* show side cross sectional views of the dirt container.
Figure 4A:
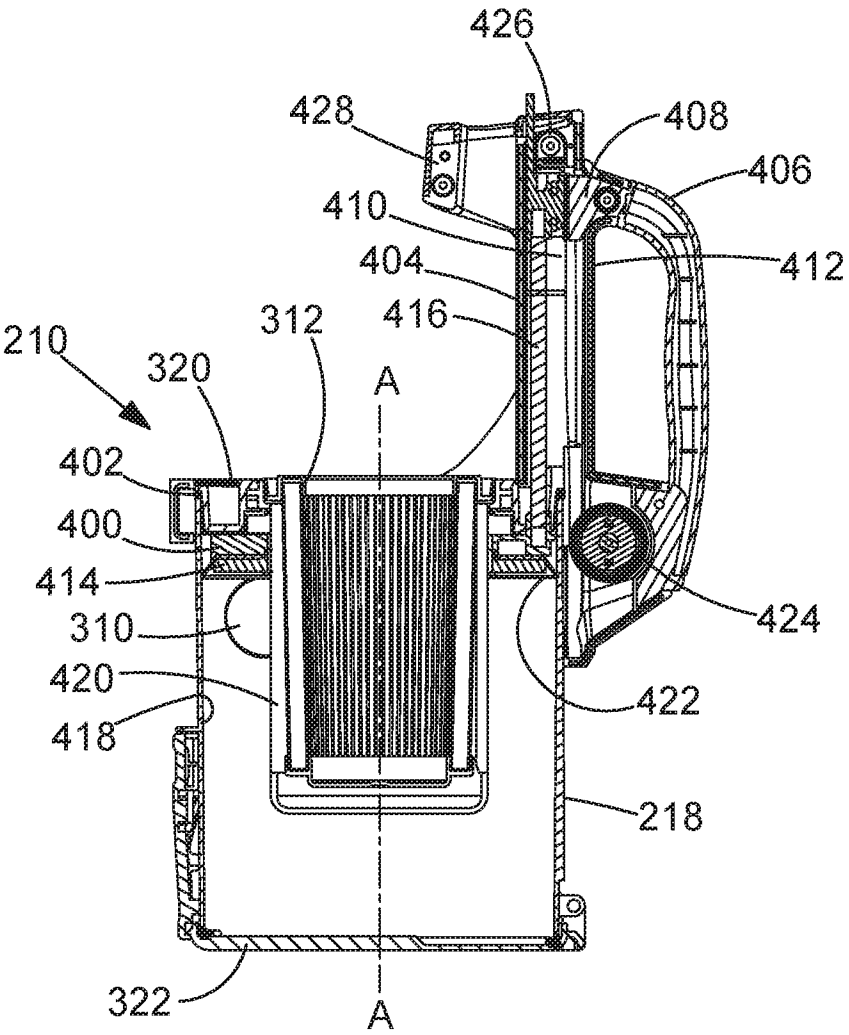

FIGS. 4*a* and 4*b* show a side cross section of the dirt container 210. The dirt container 210 has been removed from the vacuum cleaner unit 102. The dirt compactor 400 is operable when the dirt container has been removed from the vacuum cleaner unit 102. The dirt compactor 400 is also operable when the dirt container 210 is mounted in the vacuum cleaner unit 102.

FIG. 4*a* shows the dirt container 210 with the dirt compactor 400 in the stowed position. FIG. 4*b* shows the dirt compactor 400 in the compacting position during operation of the dirt compactor 400.

The dirt container 210 comprises an upstanding handle housing 404 projecting upwardly from the dirt container wall 218. The handle housing 404 is a hollow wall portion coupled to the wall 218 of the dirt container 210. The handle housing 404 comprises a slot 502 (best shown in FIG. 5*b*) for receiving a moveable primary handle 406. The moveable primary handle 406 is slidably mounted on in the slot 502 in the handle housing 404. The primary handle 406 is coupled to a handle mounting element 408 which slidably engages either side of the slot 502. In this way the handle mounting element 408 slides within an internal conduit 410 in the handle housing 404 and slides over an external wall 412 of the handle housing 404. This means that the handle mounting element 408 and the primary handle 406 are retained in the slot when the primary handle 406 is moved. The moveable primary handle 406 is moveable between a raised position and a lowered position.

The primary handle 406 is mounted on the front surface dirt container 210. The primary handle 406 is always accessible by the user. In this way the primary handle 406 faces outwardly of the vacuum cleaner 100 and the primary handle 406 is accessible irrespective of whether the vacuum cleaner unit 102 is mounted in the chassis 104 or not and whether the dirt container 210 is mounted in the housing 200 or not. The term front refers to the directionality of the vacuum cleaner unit 102 when mounted in the chassis 104 when the user is using the vacuum cleaner 100. Accordingly the primary handle 406 will face away from the user when the user grips the handle of the chassis 104 and moves the chassis 104 backwards and forwards.

FIG. 4*a* shows the handle 406 in a raised position which corresponds to the dirt compactor 400 in a stowed position. The stowed position is a position of the dirt compactor 400 that is not compressing the dirt and debris in the dirt container 210. FIG. 4*b* shows the handle 406 in a lowered position which corresponds to the dirt compactor 400 in a compacting position. The compacting position is a position of the dirt compactor 400 where dirt and debris in the dirt container 210 are urged towards an end 322 of the dirt container 210.

The primary handle 406 is mechanically coupled to a compression plate 414 via an elongate linkage 416. The elongate linkage 416 is fixed to the handle mounting element 408 and is housed within the internal conduit 410. Accordingly movement of the primary handle 406 and the handle mounting element 408 causes a corresponding movement in the linkage 416 and the compression plate 414. In some embodiments the linkage 416 is a rigid rod. In alternative embodiments the linkage 416 can be any suitable means for mechanically coupling the primary handle 406 to the compression plate 414.

The compression plate 414 is an annulus that surrounds the dirt separator 312 located in the middle of the dirt container 210. The dirt separator 312 protrudes through the centre of the annular compression plate 414 when the dirt compactor 400 is in the stowed position. The dirt separator 312 is cylindrical and a longitudinal axis of the cylindrical dirt separator 312 is aligned with the central axis A-A of the dirt separator 312. The central axis A-A of the dirt separator is substantially aligned and parallel with a longitudinal axis of the vacuum cleaner unit 102. Likewise a centre of the annular compression plate 414 is also aligned with the centre of the dirt separator 312. In other embodiments the compression plate 414 is another shape such as a circular cross section or any other suitable cross section. In the embodiment that the compression plate 414 is circular, the filter or dirt separator 312 is mounted outside of the dirt container 210. In this way, the compression plate 414 substantially fills the cross section of the dirt container 210 such that during operation of the dirt compactor 400 the compression plate 414 exerts a force on substantially all the dirt and debris in the dirt container 210.

Optionally the dirt compression plate 414 engages both an internal surface 418 of the wall 218 of the dirt container and an exterior surface 420 of the dirt separator 312. The dirt compression plat 414 comprises a resilient sweeper 422 that sweeps along the internal surface 418 and the exterior surface 422. In some embodiments the resilient sweeper is a deformable member that is in constant contact with the surfaces 418, 420. The resilient sweeper 422 is a rubber membrane or additionally or alternatively a plurality of bristles. This means that as the compression plate 414 moves towards the second end 322, the resilient sweeper sweeps and/or brushes across the internal surface 418 of the wall 218 and the exterior surface 420 of the dirt separator 312. This means that any stubbornly fixed dirt will be removed from these surfaces every time the dirt compactor 400 is operated. Since the resilient sweeper 422 engages the perforated shroud 316 of the dirt separator 312, the perforations (not shown) in the shroud 316 are kept clean and improve the air flow efficiency of the vacuum cleaner unit 102.

As mentioned above, the dirt compactor 400 is in the stowed position in FIG. 4A. In the stowed position, dirt compression plate 414 of the dirt compactor 400 is located in an uppermost position adjacent to the first end 318 of the dirt container and the lid 320. In this way, the position of the dirt compression plate 414 ensures that the maximum volume of the dirt container 210 is available for receiving the dirt and debris from the dirty air inlet 204. FIG. 4*a* shows the aperture 310 in the wall 218 of the dirt separator 210. The dirt compactor 400 is positioned in the stowed position such that the aperture 310 is between the dirt compression plate 414 and the second end 322. This means that during operation of the vacuum cleaner unit 102 when the dirt compactor 400 is in the stowed position, the dirt and debris entrained in the air flow is not received in the dirt container 210 between the first end 320 and the dirt compression plate 414. Keeping the dirt between the dirt compression plate 414 and the second end 322 prevents a build-up of hard to remove dirt which will interfere and damage the dirt compactor 400.

The primary handle 406 is optionally biased to the raised position. This means that the dirt compactor 400 is biased to the stowed position. The primary handle 406 comprises an internal spring 424 which is coupled to the handle housing 404 at peg 426. The spring 424 is a constant force coil spring. This means that the user only has to exert the same force on the primary handle irrespective of whether the primary handle 406 is in the raised position or the lowered position or somewhere in between. The internal spring 424 is threaded through the internal conduit 410. In some embodiments the biasing can be achieved with any suitable biasing means such as a coil spring, a leaf spring and so on. The biasing element can be located in any suitable position in the vacuum cleaner unit 102 for biasing the dirt compactor 400 and the primary handle 406. For example in some embodiments rather that the primary handle 406 being biased, the compression plate 414 can be coupled to the lid 320 with a biasing means such as a spring. In some embodiments there is no biasing element and the primary handle 406 is moved between the lowered position and the raised position manually by the user.

In addition to the primary handle 406 the handle housing 404 comprises a first auxiliary handle 428. The first auxiliary handle 428 is formed from a through hole 432 in the handle housing. The first auxiliary handle 428 permits the user to grip the dirt container 210 whilst also holding the primary handle 406. In this way the first auxiliary handle 428 is integral with the dirt container 210.

In some embodiments the first auxiliary handle 428 is mounted above the primary handle 406. The first auxiliary handle 428 in some embodiments is mounted on the top of the dirt container 210. In this way the first auxiliary handle 428 is further away from the second end 322 of the dirt container 210 than the primary handle 406. This means that the user is able more easily able to move the primary handle 406 towards the second end 322. The user moves the primary handle 406 towards second end 322 by pulling the handles apart. For example the user will use an action of pulling the first handle 406 apart from the first auxiliary handle 428. This is easier than requiring the user to push the primary hand 406 towards the first auxiliary handle 428, which is necessary if the first auxiliary handle 428 is mounted closed to the second end 322 than the primary handle 406.

As mentioned above, the dirt container is selectively releasable with a dirt container latch mechanism 332. The latch mechanism 332 is best shown in reference to FIG. 3. The latch mechanism 332 is biased to a locked position and the latch 332 protrudes from the housing 200 into the through hole 432 of the first auxiliary handle 428 of the dirt container 210.

In order to release the dirt container 210 from the housing 200, the user actuates the dirt container latch mechanism 332 by pressing a button (not shown) which is mechanically coupled to the dirt container latch mechanism 332. Pressing the button moves the latch 334 from a locked position wherein the latch 334 protrudes into the through hole 432 into an unlocked position wherein the latch 334 does not protrude into the through hole 432 of the first auxiliary handle 428. The first auxiliary handle 428 is received in a reciprocal recess 340 in the housing 200. This means that when the dirt container 210 is mounted on the vacuum cleaner unit 102, the first auxiliary handle 428 is concealed within the housing 200. Accordingly the first auxiliary handle 428 is not accessible by the user and cannot be gripped when the dirt container 210 is mounted on the vacuum cleaner unit 102.

When the latch 334 is in the unlocked position, the dirt container 210 is removed in a direction perpendicular to the axis A-A of the dirt container (as shown by arrow in FIG. 4A). The user grips the primary handle 406 and pulls the primary handle 406 away from the housing 200.

The first auxiliary handle 428 provides a dual purpose of a handle grip for the user when the dirt container 210 is removed from the vacuum cleaner unit 102 and a recess for receiving the latch 334 and locking the dirt container 210 to the vacuum cleaner unit 102. By providing a dual functionality to the first auxiliary handle 428, the vacuum cleaner unit 102 is more compact.

The reciprocal recess 340 extends along in the housing 200 and accommodates both the handle housing 404 and the first auxiliary handle 428. This means that the wall of the handle housing 404 or the wall 218 of the dirt container 210 do not project beyond the housing 200 of the vacuum cleaner unit 102. This provides a compact vacuum cleaner unit 102.

The latch 334 comprises a cammed surface 336 so that when the dirt container 210 is pushed back into the housing 200, the latch 332 engages an inclined surface 434 on the underside of the first auxiliary handle 428. The cammed surface 336 slides along the inclined surface 434 as the dirt container 210 is mounted on the housing 200 and the latch 332 snaps back into the locked position. The dirt container latch mechanism 332 is optional and the dirt container 210 may be held in the housing 200 with any other suitable means such as a push friction fit.

Operation of the compactor 400 will now be discussed. The user grips the first auxiliary handle 428 whilst holding the primary handle 406. The user pushes the primary handle 406 down, towards the second end 322 of the dirt container. The user moves the primary handle 406 from the raised position shown in FIG. 4*a* to the lowered position shown in FIG. 4B. This moves the dirt compactor 400 from the stowed position shown in FIG. 4A to the compacting position shown in FIG. 4B.

As the primary handle 406 moves down, the dirt compression plate 414 urges dirt between the dirt separator 312 and the wall 218 towards the second end 322. The dirt compression plate 414 squeezes the dirt between the compression plate 414 and the second end 322. In the compacting position, the annular compression plate 414 is adjacent to an end 430 of the dirt separator 312. This means that the annular compression plate 414 moves substantially along the entire length of the dirt separator 312 and the resilient sweeper 422 sweeps all of the exterior surface 420 of the dirt separator 312.

The user then releases the primary handle 406 which returns to the raised position and the dirt compression plate 414 to the stowed position. This creates free space in the dirt container 210 and the user can continue to user the vacuum cleaner unit 102 without emptying the dirt container 210.

Optionally the user can actuate the dirt compactor 400 with the door 324 in the open position. The door 324 is opened with the latch 326 as described above. In this way the dirt compactor 400 is used to urge the dirt out of the dirt container 210 when emptying. In particular the annular dirt compression plate 414 is useful for removing debris that may become stuck between the exterior surface 420 of the dirt separator 312 and the internal surface of the wall 218. This means the user avoids having to user their fingers to remove bits of accumulated hair covered in dust and the like from the dirt container 210 when emptying.

Figure 5B:
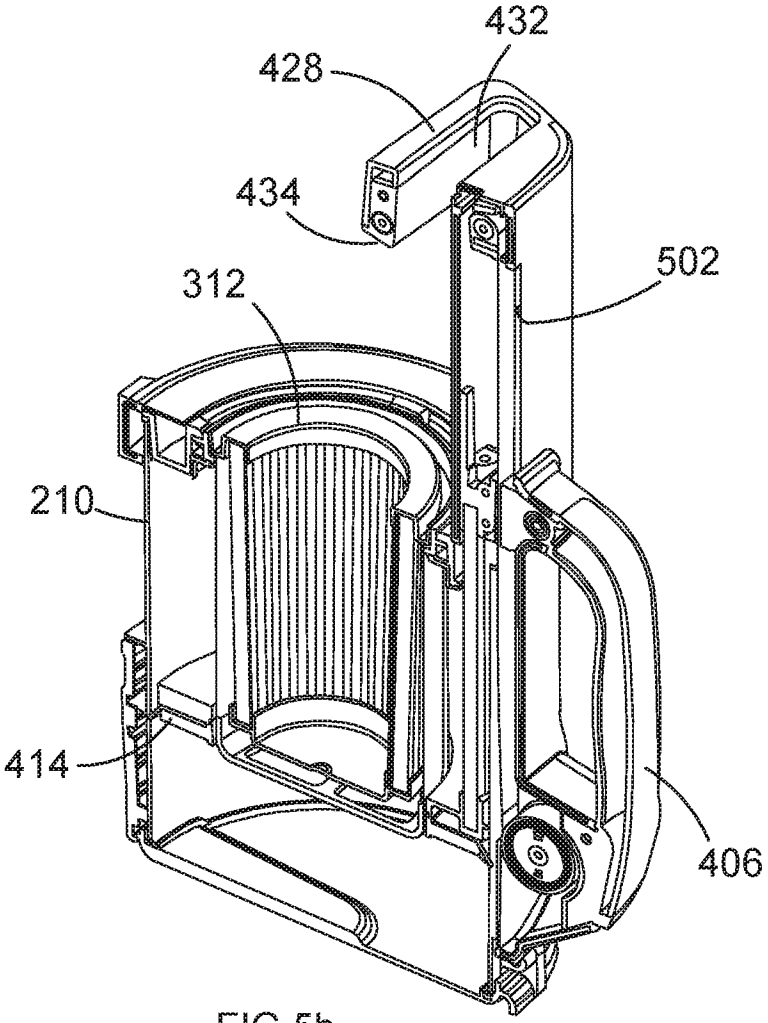
FIGS. 5*a* and 5*b* show perspective cross sectional views of the dirt container.
Figure 5A:
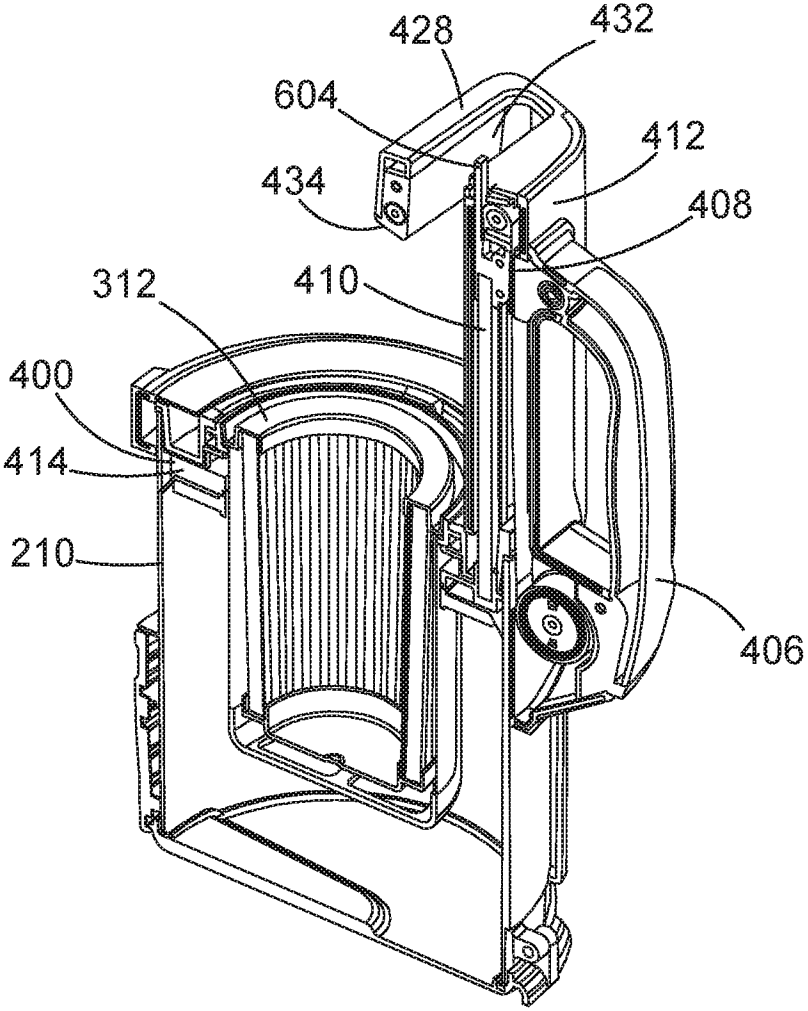
Figure 6B:
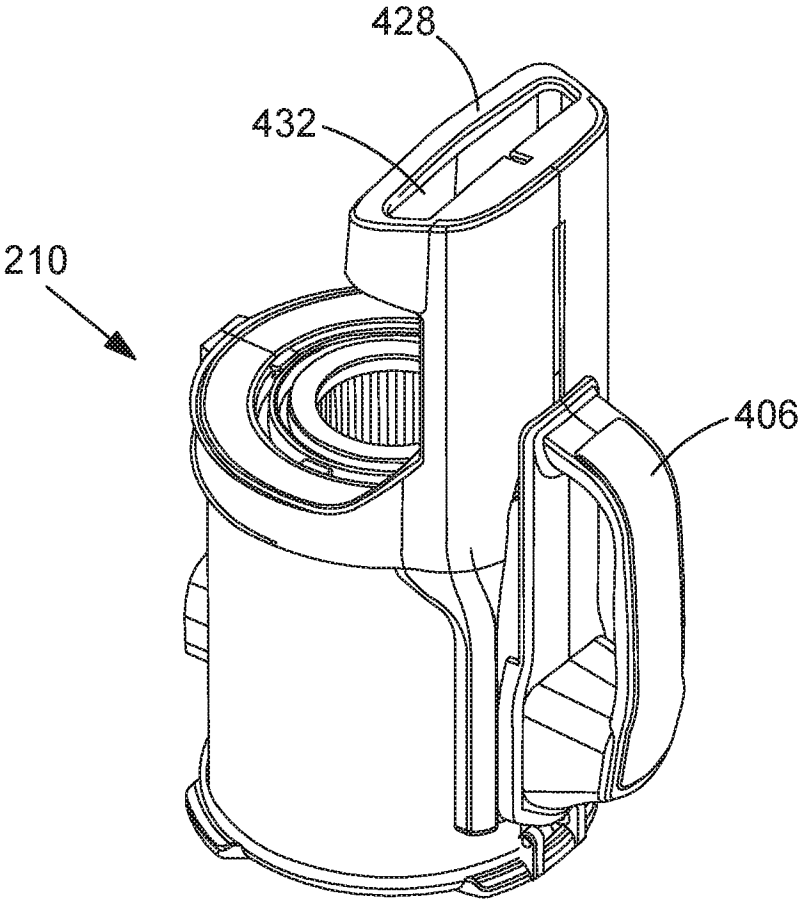
FIGS. 6*a* and 6*b* show perspective views of the vacuum cleaner.
Figure 6A:
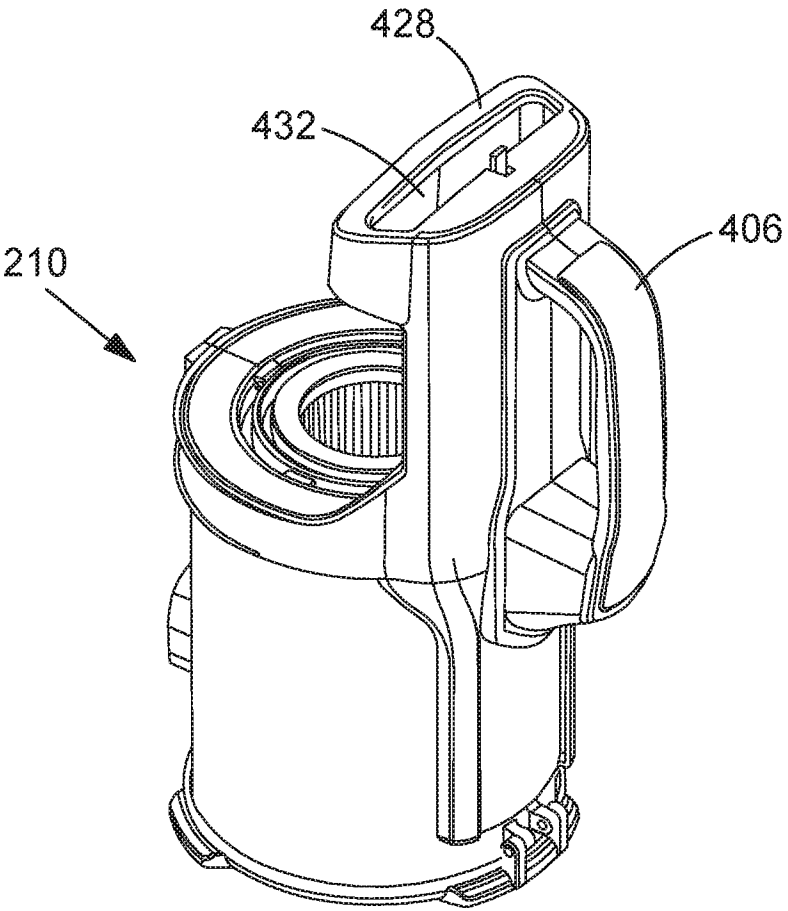

FIGS. 5A and 5B also respectively show the dirt container 210 with the dirt compactor 400 in the stowed position and the compacting position. FIGS. 5A and 5B show a perspective cross section of the dirt container 210. FIGS. 6A and 6B also respectively show the dirt container 210 with the dirt compactor 400 in the stowed position and the compacting position. FIGS. 6A and 6B show a perspective view of the dirt container 210.

As mentioned previously the aperture 310 is mounted in the wall 218 of the dirt container 210 between the dirt compression plate 414 and the second end 322. However when the dirt compactor 400 is moved into the compacting position, the dirt compaction plate 414 moves past the aperture 310. This means that the aperture 310 is located between the dirt compaction plate 414 and the first end 320 when the dirt compactor 400 is in the compacting position. Accordingly it is undesirable for the motor fan assembly 300 to generate an airflow with dirt and debris entrained therein to be input when the dirt compactor 400 is in the dirt compacting position. This is because the dirt and debris will accumulate underneath the lid 320 and the dirt can contaminate the dirt compaction mechanism and require maintenance.

The dirt container 210 can be operated with the primary handle 406 and the first auxiliary handle 428. It is also possible to operate the dirt compactor 400 with the primary handle 406 and a second auxiliary handle 338. The second auxiliary handle 338 is mounted to the vacuum cleaner unit 102. In particular the second auxiliary handle 338 is integral with the housing 200 of the vacuum cleaner unit 102.

In this way the second auxiliary handle 338 accessible to the user when the dirt container 210 is mounted in the housing 200. As mentioned previously the first auxiliary handle 428 is concealed when the dirt container 210 is mounted in the housing 200.

The operation of the dirt compactor 400 using the second auxiliary handle 338 is functionally the same as operation of the dirt compactor 400 with the first auxiliary handle 428 described above. The difference is that the use grips the second auxiliary handle 338 instead of the first auxiliary handle 428.

The first and second auxiliary handles 428, 338 mean that the user is able to operate the dirt compactor 400 irrespective of whether the dirt container 210 is mounted to the vacuum cleaner unit 102. The auxiliary handles 428, 338 allow the use to operate the dust compactor 400 in a controlled manner without the vacuum cleaner unit 102 or dirt container 210 toppling or moving during a dirt compaction operation.

In some embodiments the second auxiliary handle 338 and/or the first auxiliary handle 428 extend along a perpendicular orientation to the primary handle 406. As shown in FIGS. 2 and 3, the primary handle 406 extends along an axis which is substantially aligned with the longitudinal axis of the vacuum cleaner unit 102. The primary handle 406 extends along an axis which is substantially parallel with the axis of the dirt container A-A. The first and/or secondary auxiliary handle 428, 338 are aligned substantially transverse to the longitudinal axis A-A of the dirt container 210 or the vacuum cleaner unit 102.

The second auxiliary handle 338 is mounted on an end of the vacuum cleaner unit. When the vacuum cleaner unit 102 is upstanding on a surface, the secondary auxiliary handle 338 is mounted on the top of the vacuum cleaner unit. Similarly the first auxiliary handle 428 is mounted on the top of the dirt container 210 at the top of the handle housing 404.

In some other embodiments the second auxiliary handle 338 is mounted at any suitable position on the vacuum cleaner unit 102 to permit the user to grasp both the second auxiliary handle 338 and the primary handle 406 at the same time. For example the second auxiliary handle 338 is mounted on the side, front, back surfaces of the vacuum cleaner unit 102. In other embodiments there may be a plurality of different second auxiliary handles, each providing a different gripping position for the user.

In some embodiments the first auxiliary handle 428 is mounted at a different location on the dirt container 210. For example the first auxiliary handle 428 is mounted on the side, front, back surfaces of the dirt container 210.

In another embodiment two or more embodiments are combined. Features of one embodiment can be combined with features of other embodiments.

Embodiments of the present invention have been discussed with particular reference to the examples illustrated.

However it will be appreciated that variations and modifications may be made to the examples described within the scope of the invention.

The invention claimed is:

1. A vacuum cleaner comprising:

a housing;

a motor fan assembly mounted in the housing, the motor fan assembly arranged to generate an air flow;

a removable dirt container mountable on the housing and in fluid communication with a dirty air inlet and the motor fan assembly;

a dirt separator mounted inside the dirt container;

a moveable dirt compactor mounted in the dirt container and moveable between a first position and a second position; and wherein the movement of the dirt compactor between the first position and the second position, moves it across substantially the length of the dirt separator; and wherein the dirt container comprises a primary handle connected to the dirt compactor for actuating the dirt compactor with a first hand and a first auxiliary handle for allowing the user to grip with a second hand, wherein the primary handle is permanently fixed to the dirt compactor so there is no relative movement between the primary handle and the dirt compactor.

2. The vacuum cleaner according to claim 1, further comprising a battery to power the motor fan assembly, the battery being located in the housing.

3. The vacuum cleaner according to claim 2, wherein the motor fan assembly is positioned above the dirt container, and the battery is positioned above the motor fan assembly.

4. The vacuum cleaner according to claim 1, wherein the housing is mounted on a chassis and is removable from the chassis.

5. A vacuum cleaner comprising:

a chassis;

a housing removably mounted on the chassis;

a motor fan assembly mounted in the housing, the motor fan assembly arranged to generate an air flow;

a removable dirt container mountable on the housing and in fluid communication with a dirty air inlet and the motor fan assembly;

a dirt separator mounted inside the dirt container; and a moveable dirt compactor mounted in the dirt container and moveable between a first position and a second position, and capable of compacting dirt in the dirt separator.

6. The vacuum cleaner of claim 5, wherein the movement of the dirt compactor between the first position and the second position, moves it across a majority of the length of the dirt separator.

7. The vacuum cleaner of claim 5, further comprising a battery to power the motor fan assembly, the battery being located in the housing.

8. The vacuum cleaner according to claim 7, wherein the motor fan assembly is positioned above the dirt container, and the battery is positioned above the motor fan assembly.

9. The vacuum cleaner according to claim 8, where the dirt separator is located in an air flow path between the dirty air inlet and the motor fan assembly and the dirt separator protrudes through an aperture in the dirt compactor.

10. The vacuum cleaner according to claim 5, wherein the chassis has a first handle, and the housing has a second handle, the second handle capable of supporting the housing when removed from the chassis, the housing further including a third handle connected to the dirt compactor for moving the dirt compactor from the first position to the second position.

* * * * *